US006366540B1

(12) United States Patent
Kaminsky

(10) Patent No.: US 6,366,540 B1
(45) Date of Patent: Apr. 2, 2002

(54) OPEN-FACED WATCH DISPLAY

(76) Inventor: Edward Kaminsky, 900 Palmer Rd., Bronxville, NY (US) 10708

( * ) Notice: Subject to any disclaimer, the term of this patent is extended or adjusted under 35 U.S.C. 154(b) by 0 days.

(21) Appl. No.: 09/195,277

(22) Filed: Nov. 18, 1998

(51) Int. Cl.[7] ..... G04B 19/04
(52) U.S. Cl. ..... 368/228; 368/223; 368/80
(58) Field of Search ..... 368/80, 223, 228, 368/229

(56) References Cited

U.S. PATENT DOCUMENTS

| | | | | |
|---|---|---|---|---|
| 755,969 A | | 3/1904 | Thrasher | |
| 864,467 A | | 8/1907 | Ingraham | |
| 1,650,123 A | | 11/1927 | Gritton | |
| 1,949,024 A | | 2/1934 | Melik-Minassiantz | 58/125 |
| 2,536,237 A | * | 1/1951 | Thompson | 368/229 |
| 2,723,527 A | | 11/1955 | Smith | 58/126 |
| 2,958,181 A | * | 11/1960 | Laughlin | 368/228 |
| 3,686,884 A | | 8/1972 | Hurt | 58/127 |
| 3,712,046 A | | 1/1973 | Dill | 58/45 |
| 3,803,831 A | | 4/1974 | Horzick | 58/126 |
| 4,242,676 A | | 12/1980 | Piguet et al. | |
| 4,253,178 A | | 2/1981 | Kolaczia | 368/285 |
| 4,473,304 A | | 9/1984 | Ketner | 367/281 |
| 4,525,077 A | | 6/1985 | Ketner | 368/77 |
| 4,726,000 A | * | 2/1988 | Weiss | 368/80 |
| 5,134,595 A | | 7/1992 | Faber et al. | 368/77 |
| 5,477,508 A | | 12/1995 | Will | |
| 5,592,057 A | | 1/1997 | Kordik | |
| 5,694,378 A | | 12/1997 | Totsuka | 368/223 |

FOREIGN PATENT DOCUMENTS

| | | |
|---|---|---|
| DE | 2855935 | 7/1979 |
| EP | 031077 | 12/1980 |
| GB | 2019049 | 3/1978 |
| GB | 2057213 | 8/1979 |

* cited by examiner

*Primary Examiner*—Bernard Roskoski
(74) *Attorney, Agent, or Firm*—Cobrin & Gittes

(57) ABSTRACT

Timepieces, in a single-housed, single-crystal design, constructed to provide an unobstructed central area of the face for enhanced display of artwork, logos, holograms, designs and/or pictures.

24 Claims, 7 Drawing Sheets

(Hands 320 & 330 were placed on the same side to emphasize the parallel plane that they track)

(Hands 220 & 230 were placed on the same side to emphasize the parallel plane that they track)

(Hands 320 & 330 were placed on the same side to emphasize the parallel plane that they track)

(Hands 420 & 430 were placed on the same side to emphasize the parallel plane that they track)

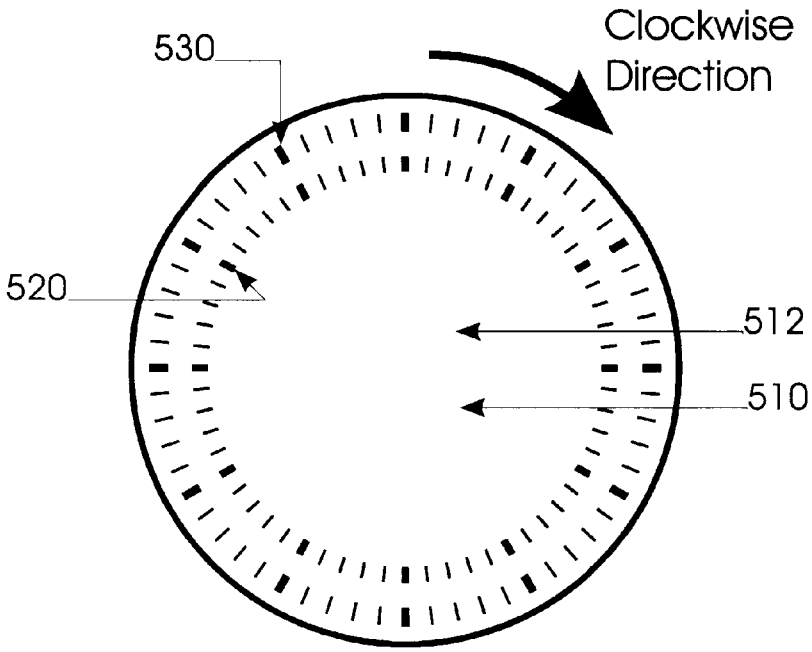
Figure 5
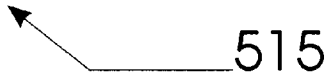

OPEN-FACED WATCH DISPLAY

FIELD OF THE INVENTION

This invention redesigns traditional watches, clocks and the like, in order to provide an unhindered view of the face. The unobstructed area, subsequently created by removing the center shaft from the face of the device along with repositioning the hands, provides a platform that will more prominently exhibit material for personal, artistic and business purposes. Some specific applications that would benefit in having an unencumbered display are pictures, artwork, promotion and advertising, three-dimensional images, and holograms.

BACKGROUND OF THE INVENTION

Watches, clocks and like apparatus for indicating time are well known. A typical device 115 is illustrated in FIGS. 1*a* and 1*b*. Commonly, device 115 will comprise a circular dial 110 that is planar and extends to device wall 117. The obverse of dial 110 is ordinarily called the face 112. Inscribed on face 112 near the periphery 116 of dial 110 are marks 111. Typically, twelve marks are inscribed around the dial in equal angular increments of 30 degrees. Each mark 111 denotes an hour of the day, AM or PM. Each mark 111 also denotes a five-minute interval within an hour. A drive mechanism 150 is located beneath dial 110. Center shaft 113 extends from drive mechanism 150, vertically, through the center of dial 110 and face 112 and continues upward for attachment with hands 120 and 130, thus, providing the linkage between the drive mechanism and the hands. Minute hand 120 and hour hand 130 extend radially outward from center shaft 113 above face 112. Minute hand 120 rotates in a circular path, around center shaft 113 and parallel to face 112, at a rate of one revolution per hour. Hour hand 130 follows the same course as minute hand 120 but in a parallel plane and rotates at a rate of one revolution every twelve hours. A second hand (not shown) may also be provided, in which case it extends radially from center shaft 113 in still a different parallel plane, and rotates at a rate of one revolution per minute. Drive mechanism 150 may be powered by a battery, wound spring or other means known in the art. Device 115 will typically provide some mechanism (not shown) for setting hands 120 and 130, to indicate the correct time of day. Once device 115 is set, drive mechanism 150 causes hands 120 and 130 to rotate in a clockwise direction as shown. The basic principals of how the time of day is determined, based on the position of hands 120 and 130 within device 115, are so well known that further explanation is unnecessary.

The limitation with such devices as described above is that hands 120 and 130 along with the portion of center shaft 113 that is above dial 110, obscure face 112 thereby hindering the display in the central part of the face. For example, it would be preferable to have a watch, bearing a design on its face, which did not have the central part of the image disrupted by physical parts of the device. Such unimpeded watch displays are particularly advantageous for promotional uses where a logo or advertisement can be imprinted on a watch face. Alternative applications are: forms of artistic expression, pictures, three dimensional sculptures or figures, interior coordinating design work, team and league affiliations, personal unique designs and/or text, etc. What is common to all these applications is the advantage of having an unobstructed face.

SUMMARY OF THE INVENTION

The present invention restructures watches, clocks and other time indicating devices to provide an unobstructed central area of the device, such as the dial face, while maintaining the overall traditional perception of the device. Some specific applications that would benefit in having an unencumbered display are time indicating devices used for advertising. These devices may bear pictures, photographs, logos, artwork, three-dimensional images, holograms, or other types of advertising indicia. Similarly, time indicating devices of the present invention may be used for purposes other than advertising, such as keepsakes, souvenirs, and gifts. When used for these purposes the dial face may be used to display photographs, pictures, artwork, three-dimensional artwork, or other non-advertising indicia.

According to one aspect of the invention, the hands of the device are connected to the center shaft on the underside of the dial and the center shaft above the dial is eliminated. The drive mechanism causes the hands to rotate circularly in the same manner as the hands of a conventional timing device as described in the Background section of this specification. Since the hands are positioned under the dial and the center shaft above the face is removed, there is no obstruction to the central viewing area of the face. This aspect of the invention has several preferred embodiments.

In one embodiment, the hands extend from the center shaft below the dial, outward beyond the periphery of the dial, bend upward then inward and parallel with the dial towards the center of the face. The hands extend inward so as to be visible and indicate the position of the hands relative to the marks on the face. In this way, the user of the device can determine the time indicated by the device without the face of the dial, inward of the marks, being obscured by the hands of the device. A modification would be to eliminate all explicit demarcations of time from the face and rely on the position of the hands to estimate the time.

In an alternate embodiment, a bezel extends inward, parallel to and concentric with the dial face but in a higher plane than the face. In this embodiment, the hands extend from the center shaft below the dial, outward beyond the periphery of the dial, bend upward extending higher than the dial face, inward and parallel to the face sufficiently to extend over the outer aspect of the bezel, upward and higher than the bezel, outward and over the bezel to provide the indication of time. The user determines the time of day by the hands pointing to the time demarcations on the bezel, or simply relying on the position of the hands to establish the time without any time demarcations on the bezel. Additionally, patterns, design work, etc. can be incorporated on the bezel.

A variation to the alternate embodiment above is to present the bezel in a plane that is below the face instead of above it. In this variation, the hands extend horizontally outward from the center shaft and over the bezel to provide the indication of time. The face, being at a higher plane, is unobscured by any aspect of the device.

Still another variation to the alternate embodiment above is to present the bezel in a coincident plane to the face. In this variation, the hands extend horizontally outward from the center shaft, upward above the bezel, and outward over the bezel to indicate the time.

In a third embodiment is a projection that is circumferentially positioned around the device walls and parallel to the dial of the device. The projection is at a higher plane than the dial and extends inward to overlap the dial. The center shaft stretches from the drive mechanism to the underside of the dial. In this embodiment, the hands extend from the center shaft below the dial, outward beyond the periphery of the dial, bend upward extending higher than the dial face, inward and parallel to the face sufficiently to extend over the outer aspect of the projection, upward and higher than the projection, outward and over the projection to provide the indication of time. The user determines the time of day by the hands pointing to the time demarcations on the projection, or simply relying on the position of the hands to establish the time without any time demarcations. Additionally, patterns, design work, etc. can be incorporated on the projection.

A variation to the third embodiment above is to present the projection in a plane that is below the face instead of above it. In this variation, the hands extend horizontally outward from the center shaft and over the projection to provide the indication of time. The face, being at a higher plane, is unobstructed by any aspect of the device.

Still another variation to the third embodiment above is to present the projection in a coincident plane to the face. In this variation, the hands extend horizontally outward from the center shaft, upward above the projection, and outward over the projection to indicate the time.

According to another aspect of the invention, two concentric sets of indicators are provided around the periphery of the dial face. One set of indicators will indicate minutes. The other set will indicate hours. Since the indicators are at the periphery of the dial face, they do not obscure the central viewing area of the face. A digital timing mechanism controls the indicators to illuminate according to the time of day. In structuring the indicators this way, the present invention contemplates distinct and separate reference points such as LED's, LCD's, hands, dials, etc., that provide an indication with reference to time-of-day (e.g., "the hands point to 2 o'clock").

In all forms and embodiments, the present invention contemplates a single-housed, single-crystal design.

These and other aspects and features of the present invention will become better understood with reference to the following drawings and written descriptions.

BRIEF DESCRIPTION OF THE DRAWINGS

FIG. 5 is an illustration of the front view of another embodiment of the present invention.

DETAILED DESCRIPTION OF THE PREFERRED EMBODIMENTS

Figure 1A:
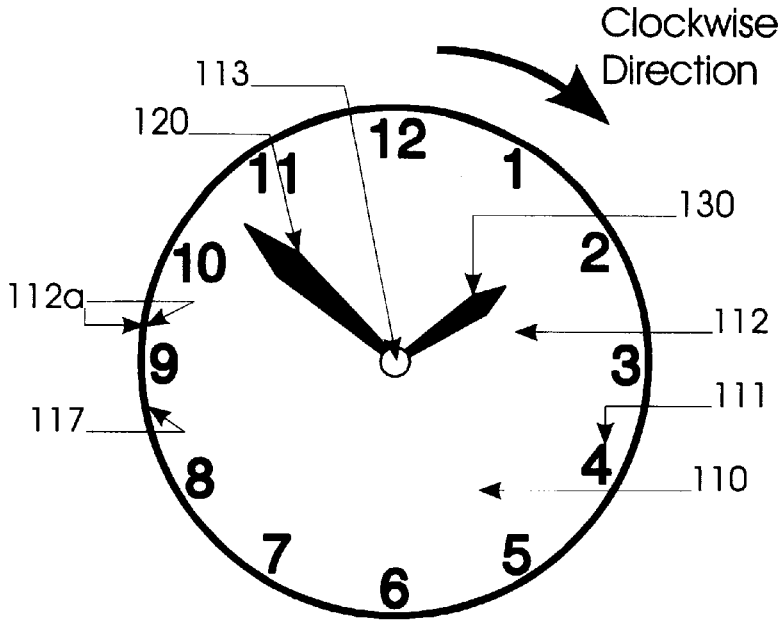
FIG. 1*a* is an illustration of the front view of a conventional watch.
Figure 1B:
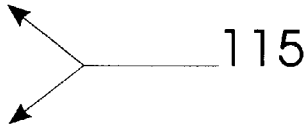
FIG. 1*b* is an illustration of a cross-sectional view of a conventional watch corresponding to FIG. 1*a*.
Figure 1B:
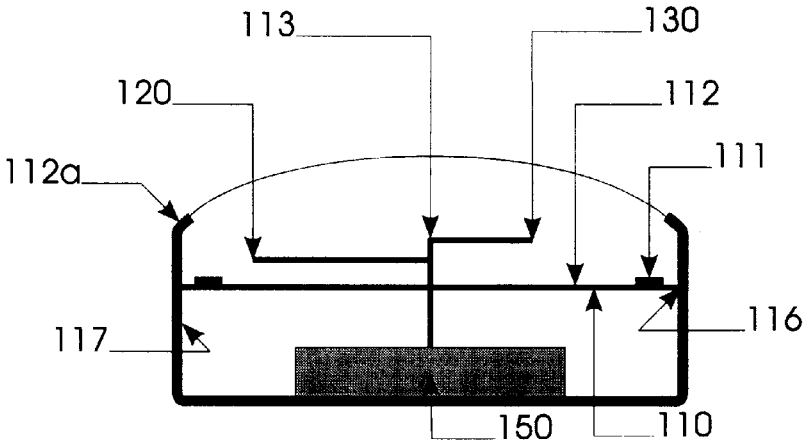
Figure 2A:
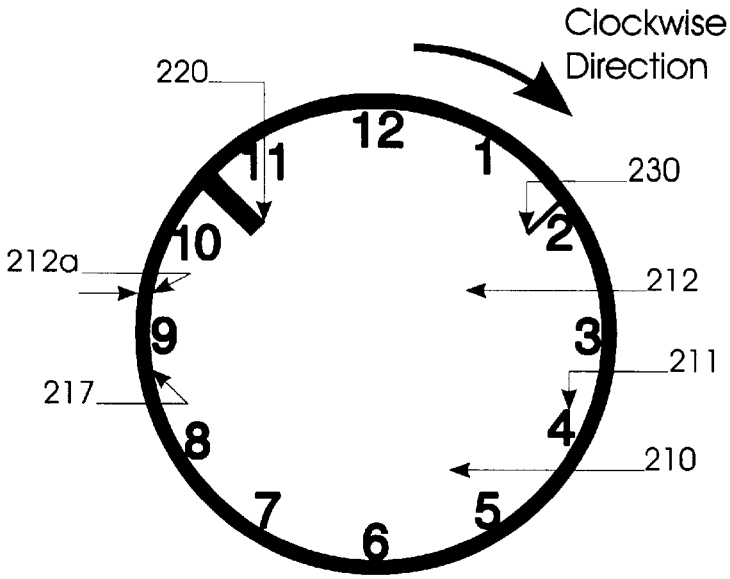
FIG. 2*a* is an illustration of the front view of an embodiment of the present invention.
Figure 2B:
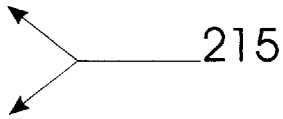
FIG. 2*b* is an illustration of a cross-sectional view of an embodiment of the present invention corresponding to FIG. 2*a*.
Figure 2B:
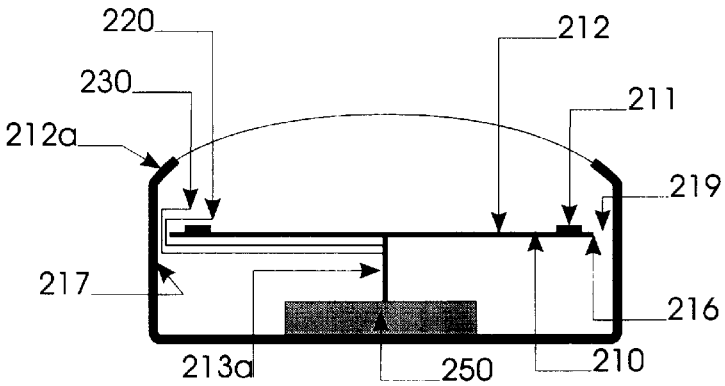

An illustration of the first preferred embodiment of the present invention is shown in FIGS. 2*a* and 2*b* as device 215. Device 215 is a single-housed, single-crystal design. Device 215 contains a circular dial 210 which will usually be planar and extends radially outward from center shaft 213*a* towards device wall 217, but not contacting device wall 217, thereby forming a gap 219 between periphery 216 of dial 210 and device wall 217. The obverse of dial 210 is face 212 on which marks are inscribed near periphery 216. Typically, twelve marks will be inscribed around the dial, in equal angular increments of 30 degrees. Each mark 211 denotes an hour of the day, AM or PM. Each mark 211 also denotes a five-minute interval within an hour. A drive mechanism 250 is located beneath dial 210. Center shaft 213*a* extends from drive mechanism 250 to the underside of dial 210. Minute hand 220 and hourhand 230 are connected to center shaft 213*a,* and hidden when viewed from face 212. The hands extend radially outward from center shaft 213*a*.

Minute hand 220, actuated by drive mechanism 250, rotates in a circular path, around center shaft 213*a* and parallel to dial 210, at a rate of one revolution per hour. Hour hand 230, also actuated by the drive mechanism, follows the same course as minute hand 220 but in a parallel plane and rotates at a rate of one revolution every twelve hours. A second hand (not shown) may also be provided, in which case it extends radially from center shaft 213*a* in still a different parallel plane, and rotates at a rate of one revolution per minute. Drive mechanism 250 may be powered by a battery, wound spring or other means known in the art. Device 215 will typically provide some mechanism (not shown) for setting hands 220 and 230, to indicate the correct time of day. Once device 215 is set, drive mechanism 250 causes hands 220 and 230 to rotate in a clockwise direction as shown.

Since hands 220 and 230 are located on the reverse side of dial 210, the face 212, which is on the obverse, is not obscured. In order for hands 220 and 230 to be visible to the extent needed to indicate time, or as desired, they extend beyond the periphery 216 of dial 210, bend upward through gap 219, and continue inward and parallel toward the center of the face 212. The end of hands 220 and 230, visible on face 212, indicate time by their position in relation to marks 211. Thus, a user of device 215 can determine the time indicated by the device without face 212 being obscured by a center shaft and hands 220 and 230. A bezel 212*a* may be extended inward to hide gap 219 when viewing face 212. A modification would be to eliminate the time demarcations on periphery 216; the user thusly, would estimate the time of day by the position of the end of the hands. An additional modification would be to inscribe the time demarcations on bezel 212*a*.

Figure 3A:
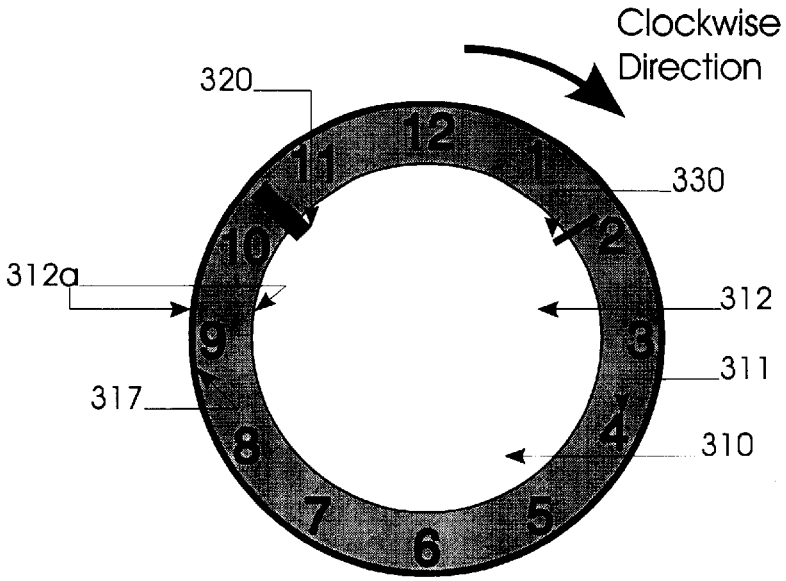
FIG. 3*a* is an illustration of the front view of an alternate embodiment of the present invention.
Figure 3B:
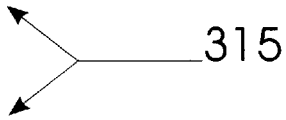
FIG. 3*b* is an illustration of a cross-sectional view of the embodiment of the present invention corresponding to FIG. 3*a*.
Figure 3B:
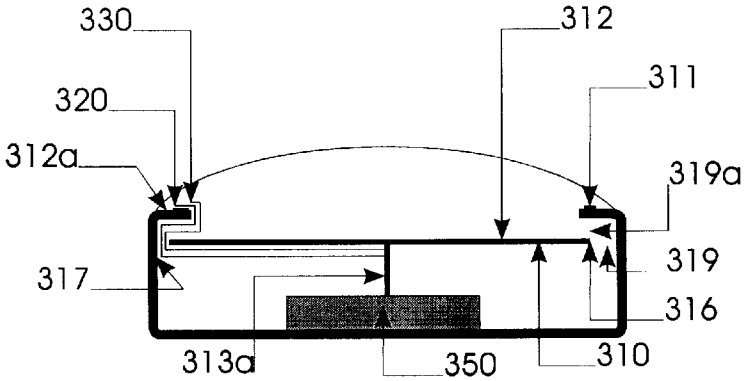

An illustration of the second preferred embodiment of the present invention is shown in FIGS. 3*a* and 3*b* as device 315. Device 315 is a single-housed, single-crystal design. Device 315 contains a circular dial 310 which will usually be planar and extend radially outward from center shaft 313*a* towards device wall 317, but not contacting the device wall 317, thereby forming a gap 319 between periphery 316 of dial 310 and device wall 317. A bezel 312*a,* that is parallel to and concentric with dial 310, is positioned above dial 310 so as to form gap 319*a* between dial face 312 and bezel 312*a.* Bezel 312*a* also overhangs gap 319 as well as periphery 316 of dial 310. Inscribed on bezel 312*a* are marks 311. Typically, twelve marks will be inscribed around the dial, in equal angular increments of 30 degrees. Each mark 311 denotes an hour of the day, AM or PM. Each mark 311 also denotes a five-minute interval within an hour. A drive mechanism 350 is located beneath dial 310. Center shaft 313*a* extends from drive mechanism 350 to the underside of dial 310. Minute and hour hands 320 and 330 are connected to center shaft 313*a,* and hidden when viewing face 312. The hands extend radially outward from center shaft 313*a.*

Minute hand 320 rotates in a circular path, around center shaft 313*a* and parallel to dial 310, at a rate of one revolution per hour. Hour hand 330 follows the same course as minute hand 320 but in a parallel plane and rotates at a rate of one revolution every twelve hours. A second hand (not shown) may also be provided, in which case it extends radially from center shaft 313*a,* in still a different parallel plane, and rotates at a rate of one revolution per minute. Drive mechanism 350 may be powered by a battery, wound spring or other means known in the art. Device 315 will typically provide some mechanism (not shown) for setting hands 320 and 330, to indicate the correct time of day. Once device 315 is set, drive mechanism 350 causes hands 320 and 330 to rotate in a clockwise direction as shown.

Since hands 320 and 330 are located on the reverse side of dial 310, the face 312, which is on the obverse, is not obscured. In order for hands 320 and 330 to be visible to the extent needed to indicate time, or as desired, the hands are substantially shaped in an "S"-shaped pattern so as to fit through gaps 319 and 319*a.* Particularly, hands 320 and 330 extend outward from center shaft 313*a,* beyond the periphery 316 of dial 310. The hands then bend upward through gap 319, inward and toward the center of face 312 and through gap 319*a* beyond the outer aspect of bezel 312*a,* upward again until above bezel 312*a,* after which hands 320 and 330 extend outward. The end of hands 320 and 330, visible on bezel 312*a,* indicate time by their position in relation to the marks 311 on bezel 312*a.* Thus, a user of device 315 can determine the time indicated by device 315 without face 312 being obscured by a center shaft and hands. A modification would be to eliminate the time demarcations on bezel 312*a;* the user thusly, would estimate the time of day by the position of the end of the hands. Another modification would be to incorporate patterns, design work, etc., on bezel 312*a.*

Figure 3C:
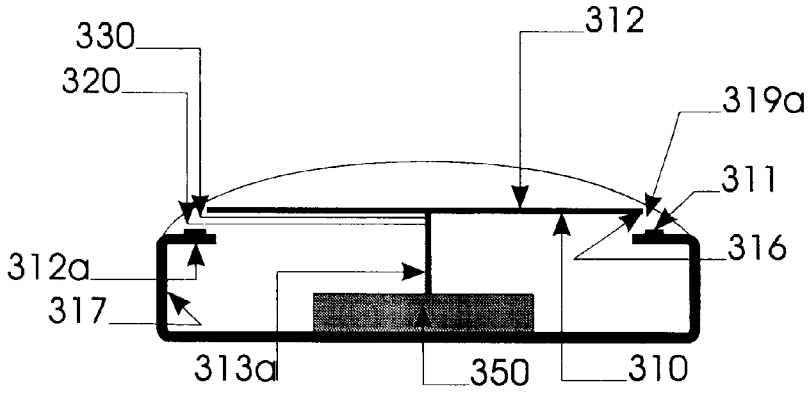
FIG. 3*c* is an illustration of a cross-sectional view of a variation of the embodiment of the present invention corresponding to FIG. 3*a*.

An illustration of a variation of this embodiment is shown in FIG. 3*c.* Dial 310 is in a higher plane than bezel 312*a,* thereby creating gap 319*a.* Hands 320 and 330 extend from central shaft 313*a* horizontally outward, beyond the outer aspect of bezel 312*a* through gap 319*a* extending beyond the periphery 316 of dial 310 and overlap the inscription marks 311 that appear on bezel 312*a.*

Figure 3D:
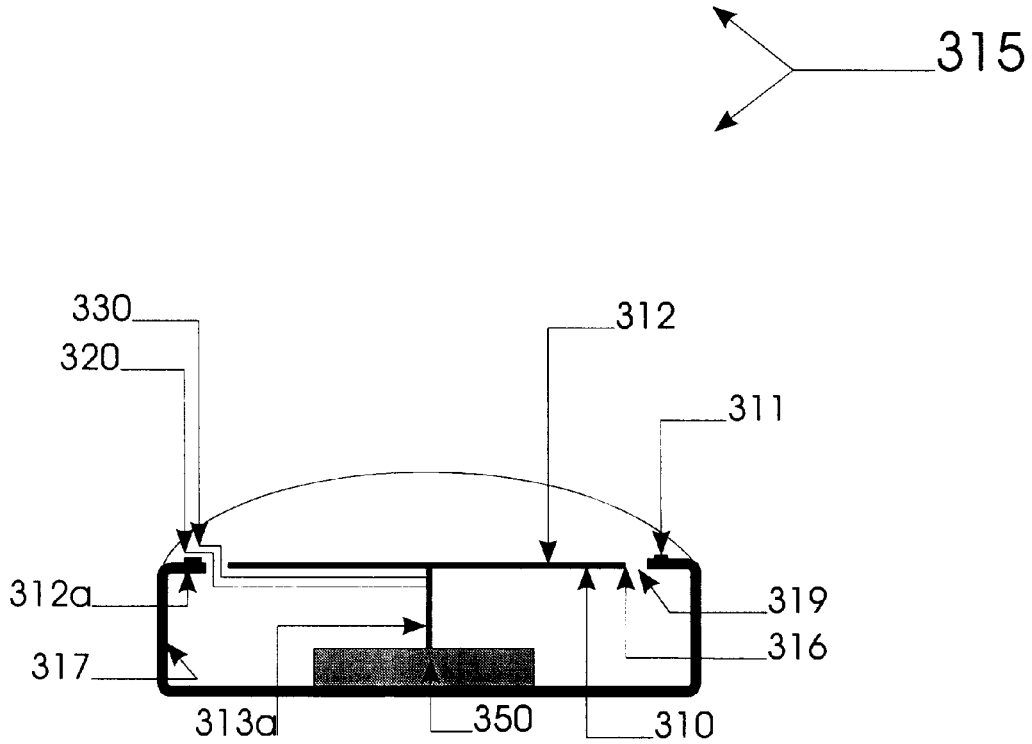
FIG. 3*d* is an illustration of a cross-sectional view of another variation of the embodiment of the present invention corresponding to FIG. 3*a*.

An illustration of an additional variation of this embodiment is shown in FIG. 3*d.* Dial 310 is in a coincident plane with bezel 312*a* and inferior to the outer aspect of bezel 312*a* thus creating gap 319. Hands 320 and 330 extend from central shaft 313*a* outward, beyond periphery 316, upward through gap 319 until above bezel 312*a,* then outward over bezel 312*a.*

Figure 4A:
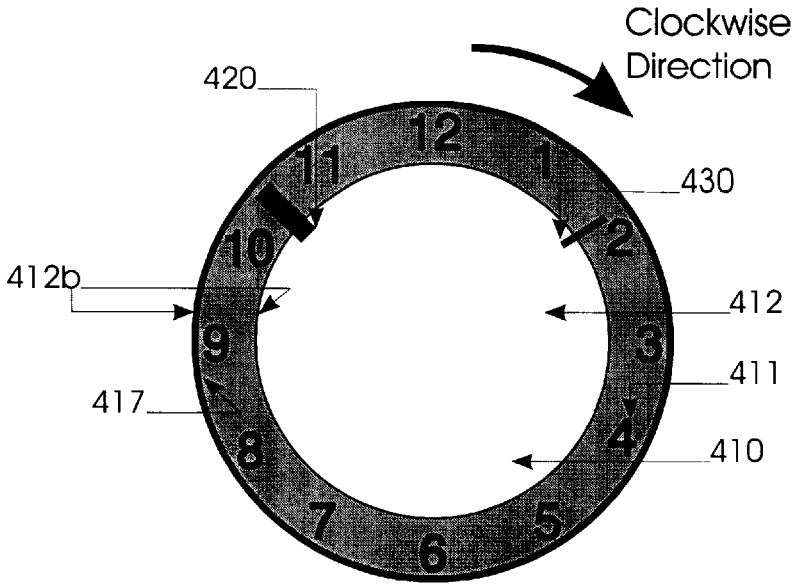
FIG. 4*a* is an illustration of the front view of a third embodiment of the present invention.
Figure 4B:
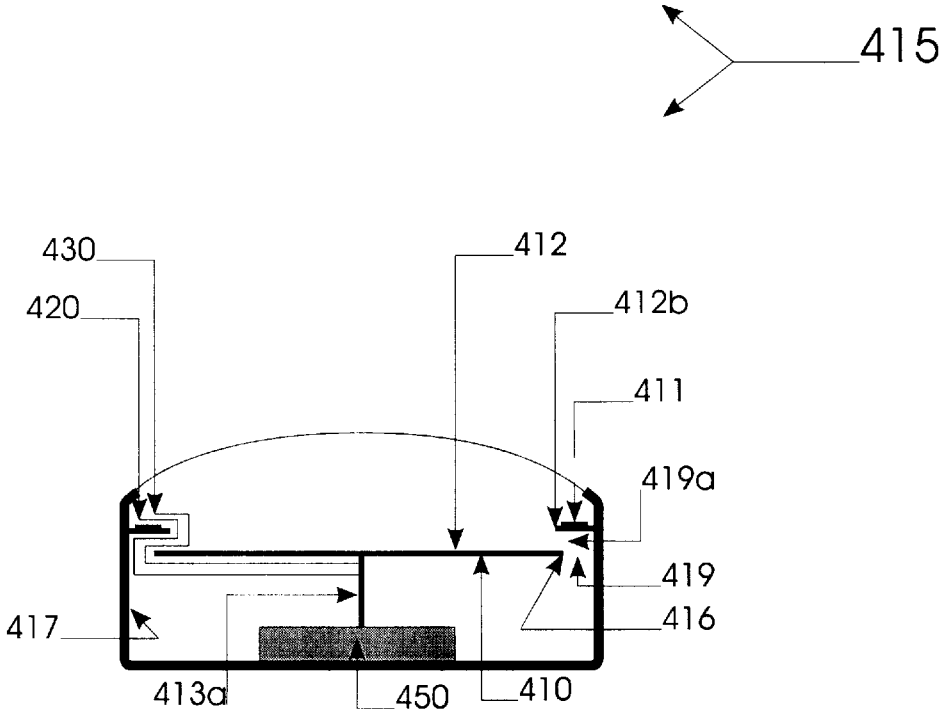
FIG. 4*b* is an illustration of a cross-sectional view of the embodiment of the present invention corresponding to FIG. 4*a*.

An illustration of the third preferred embodiment of the present invention is shown in FIGS. 4*a* and 4*b* as device 415. Device 415 is a single-housed, single-crystal design. Device 415 contains a circular dial 410 which will usually be planar and extend radially outward from center shaft 413*a* towards device wall 417, but not contacting the device wall 417, thereby forming a gap 419 between periphery 416 of dial 410 and device wall 417. A projection 412*b,* extending from device wall 417 inward, is parallel to and concentric with dial 410. Projection 412*b* is positioned above dial 410, thus forming gap 419*a* between dial face 412 and projection 412*b.* Projection 412*b* also overhangs gap 419 as well as periphery 416 of dial 410. Inscribed on projection 412*b* are marks 411. Typically, twelve marks will be inscribed around the dial, in equal angular increments of 30 degrees. Each mark 411 denotes an hour of the day, AM or PM. Each mark 411 also denotes a five-minute interval within an hour. A drive mechanism 450 is located beneath dial 410. Center shaft 413*a* extends from drive mechanism 450 to the underside of dial 410. Minute and hour hands 420 and 430 are connected to center shaft 413*a,* and hidden when viewing face 412. The hands extend radially outward from center shaft 413*a.*

Minute hand 420 rotates in a circular path, around center shaft 413*a* and parallel to dial 410, at a rate of one revolution per hour. Hour hand 430 follows the same course as minute hand 420 but in a parallel plane and rotates at a rate of one revolution every twelve hours. A second hand (not shown) may also be provided, in which case it extends radially from center shaft 413*a,* in still a different parallel plane, and rotates at a rate of one revolution per minute. Drive mechanism 450 may be powered by a battery, wound spring or other means known in the art. Device 415 will typically provide some mechanism (not shown) for setting hands 420 and 430, to indicate the correct time of day. Once device 415 is set, drive mechanism 450 causes hands 420 and 430 to rotate in a clockwise direction as shown.

Since hands 420 and 430 are located on the reverse side of dial 410, the face 412, which is on the obverse, is not obscured. In order for hands 420 and 430 to be visible to the extent needed to indicate time, or as desired, the hands are substantially shaped in an "S"-shaped pattern so as to fit through gaps 419 and 419*a.* Particularly, hands 420 and 430 extend outward from center shaft 413*a,* beyond the periphery 416 of dial 410. The hands then bend upward through gap 419, inward and toward the center of face 412 and through gap 419*a* beyond the outer aspect of projection 412*b,* upward again until above projection 412*b,* after which hands 420 and 430 extend outward. The end of hands 420 and 430, visible on projection 412*b,* indicate time by their position in relation to the marks 411 on projection 412*b.* Thus, a user of device 415 can determine the time indicated by device 415 without face 412 being obscured by a center shaft and hands. A modification would be to eliminate the time demarcations on projection 412*b;* the user thusly, would estimate the time of day by the position of the end of the hands. Another modification would be to incorporate patterns, design work, etc., on projection 412*b.*

Figure 4C:
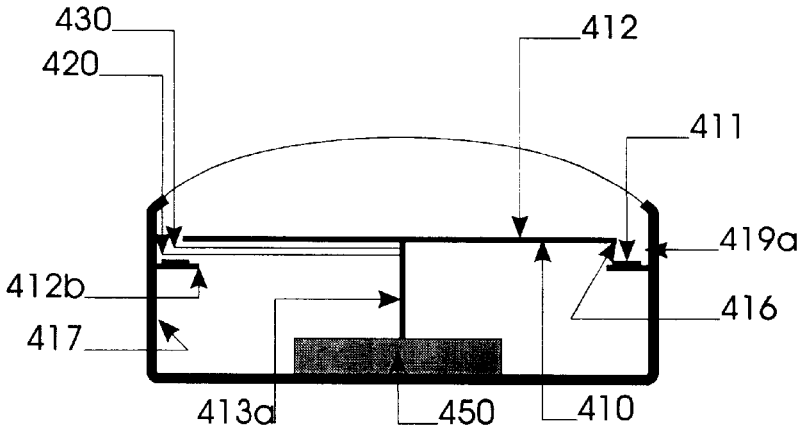
FIG. 4*c* is an illustration of a cross-sectional view of a variation of the embodiment of the present invention corresponding to FIG. 4*a*.

An illustration of a variation of this embodiment is shown in FIG. 4*c.* Dial 410 is in a higher plane than projection 412*b,* thereby creating gap 419*a.* Hands 420 and 430 extend from central shaft 413*a* horizontally outward, beyond the outer aspect of projection 412*b* through gap 419*a* extending beyond the periphery 416 of dial 410 and overlap the inscription marks 411 that appear on projection 412*b.*

Figure 4D:
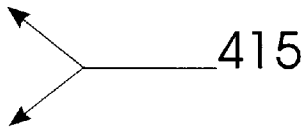
FIG. 4*d* is an illustration of a cross-sectional view of another variation of the embodiment of the present invention corresponding to FIG. 4*a*.
Figure 4D:
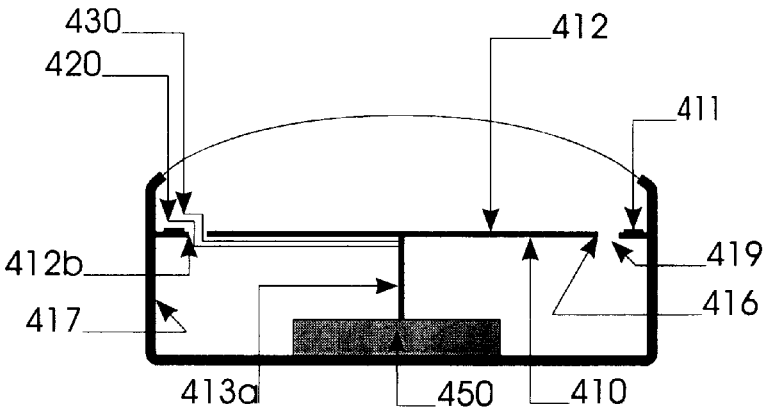

An illustration of an additional variation of this embodiment is shown in FIG. 4*d.* Dial 410 is in a coincident plane with projection 412*b* and inferior to the outer aspect of projection 412*b* thus creating gap 419. Hands 420 and 430 extend from central shaft 413*a* outward, beyond periphery 416, upward through gap 419 until above projection 412*b*, then outward over projection 412*b*.

A second aspect of the present invention is shown in FIG. 5. Device 515 is a single-housed, single-crystal design. Device 515 is typically circular and planar in shape. Visible on the face 512 of dial 510 are two sets of indicators 520 and 530. The outer indicators 530 denote the hour of the day. The inner indicators 520 denote minutes of an hour. Indicators 520 and 530 are positioned circumferentially around the periphery of dial 510 so that the central viewing area of dial face 512 is open for display of sundry works. The indicators comprise light emitting diodes (LEADS) in the preferred embodiment, although liquid crystal display elements (LADS) could be used as an alternative. One advantage to using LEADS is that a user can read the time indicated by device 515 in a dark environment without the use of an additional light source. Indicators 520 may be designed to emit a color that is different from the color emitted by indicators 530. For example, indicators 520 may emit blue, whereas indicators 530 may emit red.

A digital timing mechanism (not shown) causes the LEDs to illuminate sequentially in a clockwise direction. As an example, indicator 530 has 60 LEDs spaced by equal angular increments of six degrees around the circumference of face 512. Indicator 520 also has 60 LEDs spaced by equal angular increments of six degrees around the circumference of face 512 but within the perimeter of the set of indicators 530. The digital timing mechanism causes the LEDs of indicator 520 to illuminate in succession. After a one-minute interval, as determined by the digital timing mechanism, the LED within indicator set 520 that is currently illuminated is turned off and the adjacent LED, in a clockwise direction, is turned on. Although one-minute increments are preferred, the increments as well as the corresponding number of LEDs may vary.

The digital timing mechanism also causes the LEDs of indicator 530 to illuminate consecutively in a clockwise direction as shown. In the example, after a time interval of twelve-minutes, as determined by the digital timing mechanism, the LED within indicator set 530 that is currently illuminated is turned off and the adjacent LED, in a clockwise direction, is turned on. Although twelve-minute increments are preferred, the increments as well as the corresponding number of LEDs may vary.

Reference for the time of day, within device 515, can be obtained by having time demarcations inscribed on the bezel or on an outer aspect of face 512. A modification would be to forgo time demarcations in lieu of designs and/or text or rely simply on the position of the lit LEDs.

The peripheral configuration achieves the object of maintaining an unhindered display area for presentation of the primary design within the center of the device. A battery will typically power the digital timing mechanism. The design of the circuitry in conjunction with the indicators is within the ordinary skill level of persons in the art.

The present invention, therefore, is well adapted to carry out the objects and attain the ends and advantages mentioned herein as well as other ends and advantages that are made apparent from the disclosure. While preferred embodiments of the invention have been described for the purpose of disclosure, numerous changes and modification to those embodiments described herein will be readily apparent to those skilled in the art and are encompassed within the spirit of the invention and the scope of the following claims.

What is claimed is:

1. A time-indicating apparatus that provides an indication of time without obscuring a dial face, said apparatus comprising: a crystal;

a dial having the dial face, the dial being within a dial plane:

a bezel that is substantially concentric to and parallel to the dial face and arranged in a manner that forms a gap between said bezel and said dial face;

a drive mechanism;

one or more indicators, actuated by the drive mechanism, the dial being between the crystal and the drive mechanism to determine time;

wherein said indicators are connected to the drive mechanism on a side of the dial opposite the dial face so as not to obscure the dial face, the indicators each extending through said gap and having a portion that overlays the bezel as reviewed thru the crystal.

2. The apparatus of claim 1, wherein the indicators are shaped to extend outwardly toward an outer periphery of the dial until slightly past the periphery, then extend upward and through the gap between the periphery and a side wall of the apparatus until slightly above the dial face, then extend inward toward the center of the dial face so as to provide an indication of time relative to the dial face without obscuring the dial face.

3. The apparatus of claim 1, wherein, said bezel being located in a plane above the dial face to form the gap therebetween, wherein the indicators are shaped to extend outwardly toward an outer periphery of the dial until slightly past the periphery, then extend upward and through a gap between the periphery and a side wall of the apparatus until slightly above the dial face, then extend inward toward the center of the dial face through the gap between the bezel and the dial face until slightly past an outer periphery of the bezel, then extend upward until slightly above the bezel, then extend outward away from the center of the dial face so as to provide an indication of time relative to the bezel without obscuring the dial face.

4. The apparatus of claim 1, wherein, said bezel located in a plane below the dial face to form a gap therebetween, wherein the indicators are shaped to extend outwardly toward an outer periphery of the dial through the gap between the bezel and the dial face so as to provide an indication of time relative to the bezel without obscuring the dial face.

5. The apparatus of claim 1, wherein said bezel being located in a plane that is substantially coincident with the dial face, such that the gap is formed between the bezel and the dial face, wherein the indicators are shaped to extend outwardly toward an outer periphery of the dial until slightly past the periphery, then extend upward and through the gap between the bezel and the dial face, then extend outward away from the center of the dial face so as to provide an indication of time relative to the bezel without obscuring the dial face.

6. The apparatus of claim 1, wherein, said projection extending from a side wall of the apparatus inward toward the center of the dial face and located in a plane above the dial face to form the gap therebetween, wherein the indicators are shaped to extend outwardly toward an outer periphery of the dial until slightly past the periphery, then extend upward and through a gap between the periphery and a side wall of the apparatus until slightly above the dial face, then extend inward toward the center of the dial face through the gap between the projection and the dial face until slightly past an outer periphery of the projection, then extend upward until slightly above the projection, then extend outward away from the center of the dial face so as to provide an indication of time relative to the projection without obscuring the dial face.

7. The apparatus of claim 1, further comprising a projection that is substantially concentric to and parallel to the dial face, said projection extending from a side wall of the apparatus inward toward the center of the dial face and located in a plane below the dial face to form a gap therebetween, wherein the indicators are shaped to extend outwardly toward an outer periphery of the dial through the gap between the projection and the dial face so as to provide an indication of time relative to the projection without obscuring the dial face.

8. The apparatus of claim 1, wherein the projection is substantially concentric to and in a plane that is substantially coincident with the dial face, wherein the indicators are shaped to extend outwardly toward an outer periphery of the dial until slightly past the periphery, then extend upward and through the gap between the projection and the dial face, then extend outward away from the center of the dial face so as to provide an indication of time relative to the projection without obscuring the dial face.

9. The apparatus of claim 7, wherein the dial face contains non-advertising indicia.

10. The apparatus of claim 1, wherein the dial face contains advertising indicia.

11. The apparatus of claim 2, wherein the dial face contains advertising indicia.

12. The apparatus of claim 3, wherein the dial face contains advertising indicia.

13. The apparatus of claim 4, wherein the dial face contains advertising indicia.

14. The apparatus of claim 5, wherein the dial face contains advertising indicia.

15. The apparatus of claim 6, wherein the dial face contains advertising indicia.

16. The apparatus of claim 7, wherein the dial face contains advertising indicia.

17. The apparatus of claim 8, wherein the dial face contains advertising indicia.

18. The apparatus of claim 1, wherein the dial face contains non-advertising indicia.

19. The apparatus of claim 2, wherein the dial face contains non-advertising indicia.

20. The apparatus of claim 3, wherein the dial face contains non-advertising indicia.

21. The apparatus of claim 4, wherein the dial face contains non-advertising indicia.

22. The apparatus of claim 5, wherein the dial face contains non-advertising indicia.

23. The apparatus of claim 6, wherein the dial face contains non-advertising indicia.

24. The apparatus of claim 8, wherein the dial face contains non-advertising indicia.

* * * * *